US008850930B1

(12) United States Patent
Chern

(10) Patent No.: US 8,850,930 B1
(45) Date of Patent: Oct. 7, 2014

(54) ADJUSTABLE WRENCH

(76) Inventor: Shwu-Ruu Chern, Taichung (TW)

( * ) Notice: Subject to any disclaimer, the term of this patent is extended or adjusted under 35 U.S.C. 154(b) by 238 days.

(21) Appl. No.: 13/587,844

(22) Filed: Aug. 16, 2012

(51) Int. Cl.
*B25B 13/10* (2006.01)
*B25B 13/14* (2006.01)
*B25B 13/24* (2006.01)

(52) U.S. Cl.
USPC ..... 81/165; 81/170; 81/133

(58) Field of Classification Search
USPC ..... 81/133–135, 145, 157, 165, 170, 177.9
See application file for complete search history.

(56) References Cited

U.S. PATENT DOCUMENTS 1,205,149 A * 11/1916 Bovee ..... 81/177.9
3,926,077 A * 12/1975 Nordgren ..... 81/126
6,418,819 B1 * 7/2002 Kuo ..... 81/165
6,595,089 B1 * 7/2003 Stojanowski ..... 81/165
7,017,455 B2 * 3/2006 Hsien ..... 81/177.1
8,276,484 B2 * 10/2012 Huang ..... 81/165

* cited by examiner

*Primary Examiner* — David B Thomas
(74) *Attorney, Agent, or Firm* — Pro-Techtor Int'l Services; Ian B. Oglesby

(57) ABSTRACT

An adjustable wrench includes a handle and a head is pivotably connected to the handle. The head has a guide hole through which a pin extends and the pin has a side hole defined radially so as to receive a positioning unit therein. A clamping device has a fixed jaw and a movable jaw, the fixed jaw has a travel path and the movable jaw has a toothed rod. A slide slot is defined in one side of the fixed jaw which has a board inserted into the slot of the head. The fixed jaw has an opening in which a push spring, a stop plate and a worm rod are received. The movable jaw is slidably connected to the slide slot. The toothed rod is located in the travel path and engaged with the worm rod.

6 Claims, 10 Drawing Sheets

ADJUSTABLE WRENCH

FIELD OF THE INVENTION

The present invention relates to an adjustable wrench, and more particularly, to an adjustable wrench the clamping unit is rotatable back and forth without removing from the clamped object.

BACKGROUND OF THE INVENTION

The conventional adjustable wrench is used for tightening or loosening a nut, and generally comprises a handle with a fixed jaw at one end of the handle, a movable jaw is movably connected to the handle and located corresponding to the fixed jaw. A bolt is connected to the lower end of the movable jaw and the handle has a worm rod connected thereto, wherein the worm rod is engaged with the bolt. By rotating the worm rod, the movable jaw moves toward or away from the fixed jaw to clamp the nut or release the nut.

However, the movable jaw cannot be removed from the fixed jaw automatically when the nut is clamped between the fixed and movable jaws. Besides, when the space is narrow and only allows the handle to be rotated less than 90 degrees, the user has to move the movable jaw away from the fixed jaw, and then rotate the handle, and the movable jaw is again moved to clamp the nut so as to rotate the handle at limited angle. The steps have to be repeatedly operated to tighten or loosen the nut. This takes a lot of time and the efficiency is low.

Furthermore, the fixed jaw and the movable jaw cannot be pivoted an angle so that when the nut is located at an angular position, the conventional adjustable wrench cannot reach the nut.

The present invention intends to provide an improved adjustable wrench which is operated like a ratchet wrench without repeatedly operating the movable jaw.

SUMMARY OF THE INVENTION

The present invention relates to an adjustable wrench and comprises a handle having two lugs and each lug has a through hole. A head has a protrusion which is located between the two lugs and a pivot extends through the two through holes and the protrusion. The head has a guide hole which has a first position and a second position. A pin extends through the guide hole and has a side hole defined radially in the outer periphery thereof. A positioning unit is located in the side hole and engaged with the first position of the guide hole. The head has a slot defined in the second end thereof and an opening is defined in one side of the head and communicates with the slot. Two wing plates extend from the head and each wing plate has a hole. A pin extends through the holes of the two wing plates. A clamping device has a fixed jaw and a movable jaw. The fixed jaw has a travel path and the movable jaw has a toothed rod connected thereto. A slide slot is defined in one side of the fixed jaw. The fixed jaw has a board extending therefrom and the board is inserted into the slot of the head. The board has a stop extending therefrom. The fixed jaw has an opening in which a push spring, a stop plate and a worm rod are received. A pin extends through the push spring, the stop plate and the worm rod. The fixed jaw is connected to the head by inserting the board in the slot of the head. The pin extends through the two wing plates and the board. The movable jaw is slidably connected to the slide slot. The toothed rod is located in the travel path and engaged with the worm rod.

Preferably, a recess is defined in the handle and located close to the lugs. A resilient member and a push rod are located in the recess. The push rod has a first notch and a second notch. A bead is engaged with one of the first and second notches. The head has multiple third notches defined in the outer periphery of the protrusion and the bead is engaged with one of the third notches.

Preferably, the resilient member is a spring.

Preferably, the positioning unit comprises a spring and an end piece.

Preferably, each of the wing plates of the head has a curved face defined in the outer periphery thereof. The fixed jaw has a recessed portion with which the curved face is engaged.

Preferably, the pin extends through the holes of the two wing plates and a torsion spring. The torsion spring has two legs which are respectively in contact with the slot of the head and a side of the fixed jaw.

The primary object of the present invention is to provide an adjustable wrench wherein the head can be pivoted an angle to reach an object.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
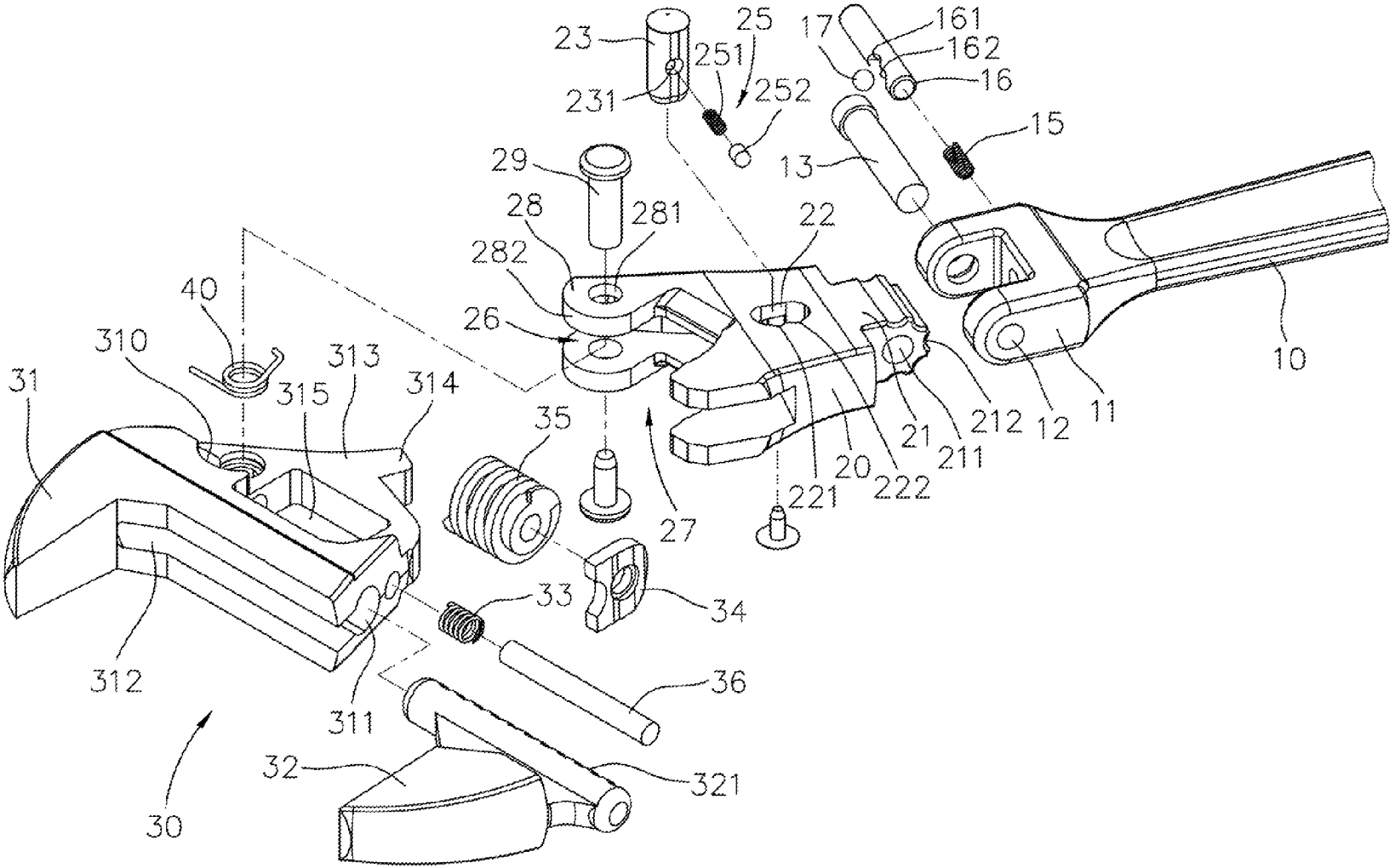
FIG. 1 is an exploded view to show the wrench of the present invention.
Figure 2:
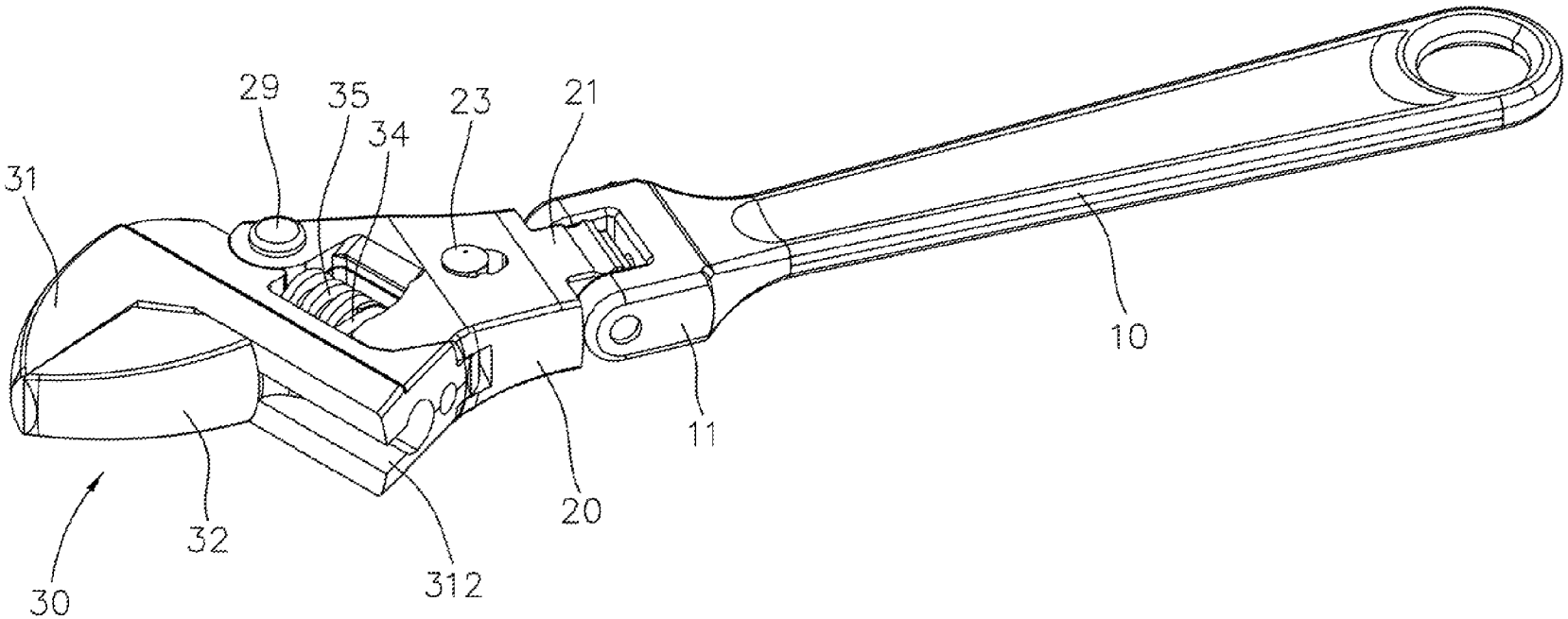
FIG. 2 is a perspective view to show the wrench of the present invention.
Figure 3:
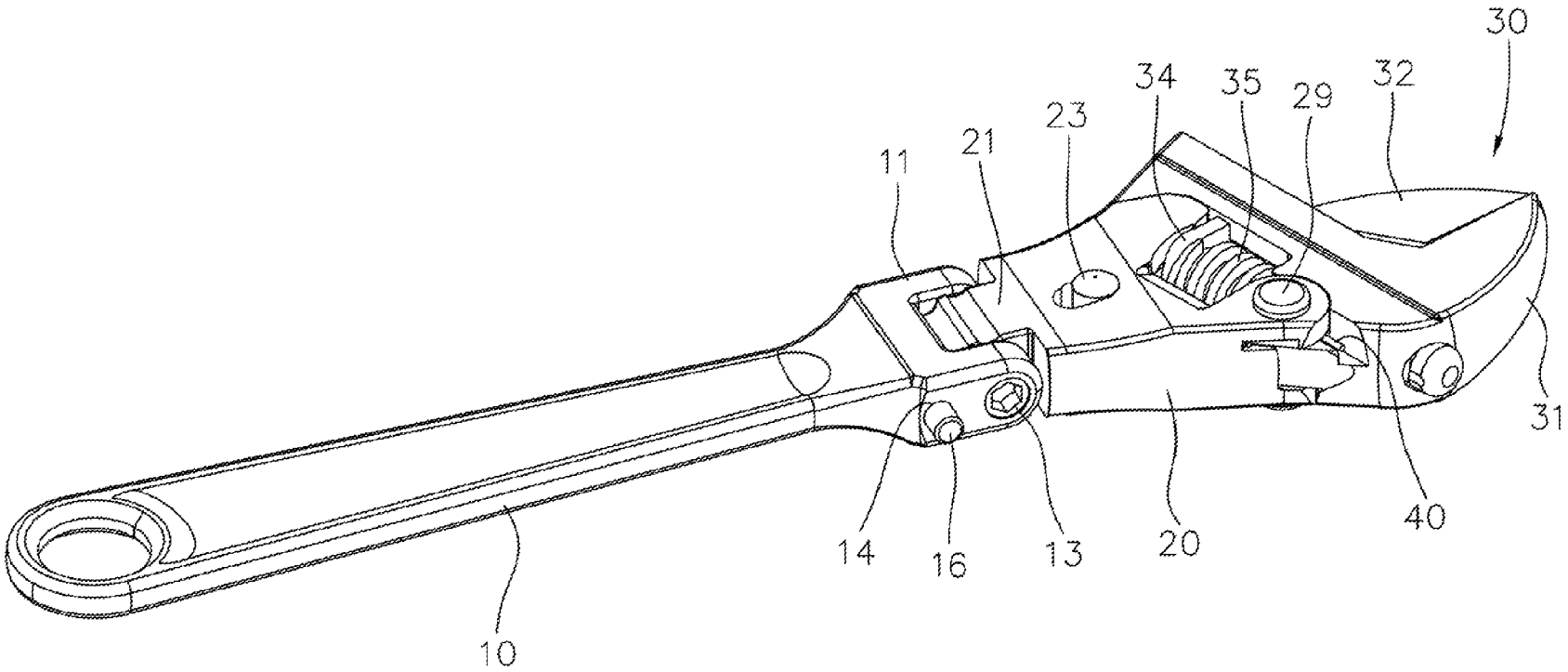
FIG. 3 is another perspective view to show the wrench of the present invention.
Figure 4:
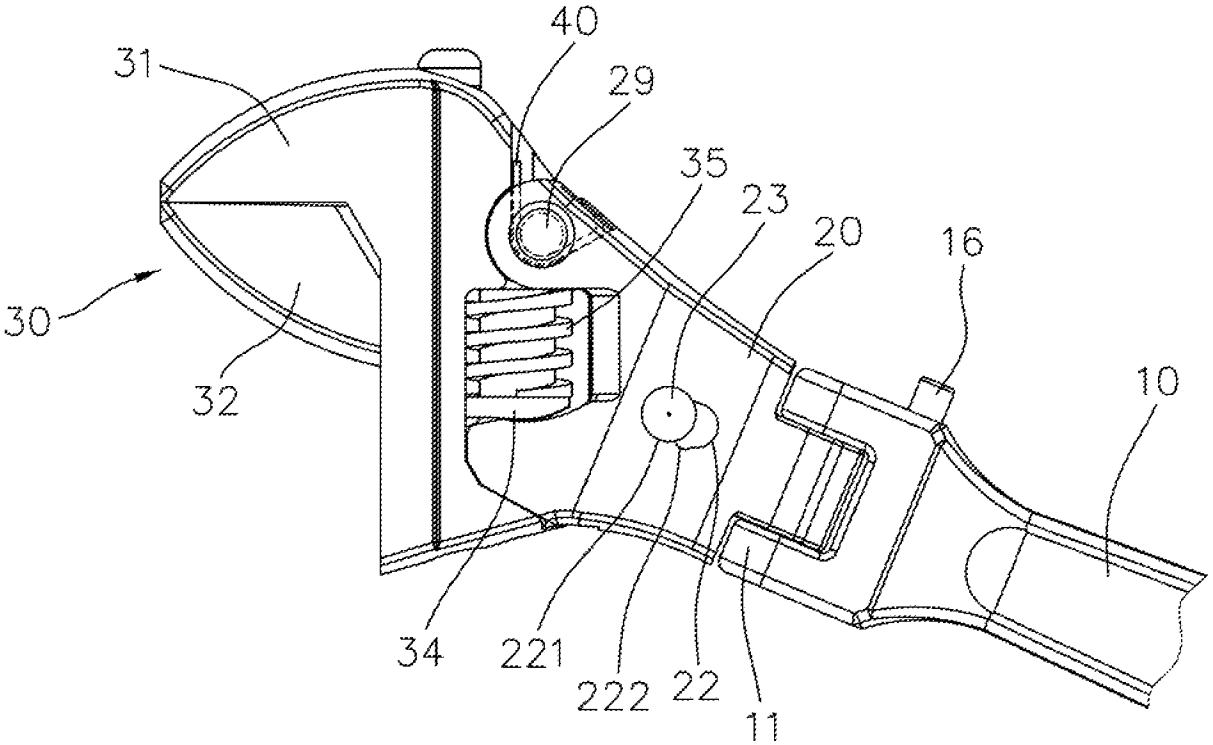
FIG. 4 shows that the movable jaw is in contact with the fixed jaw of the wrench of the present invention.
Figure 5:
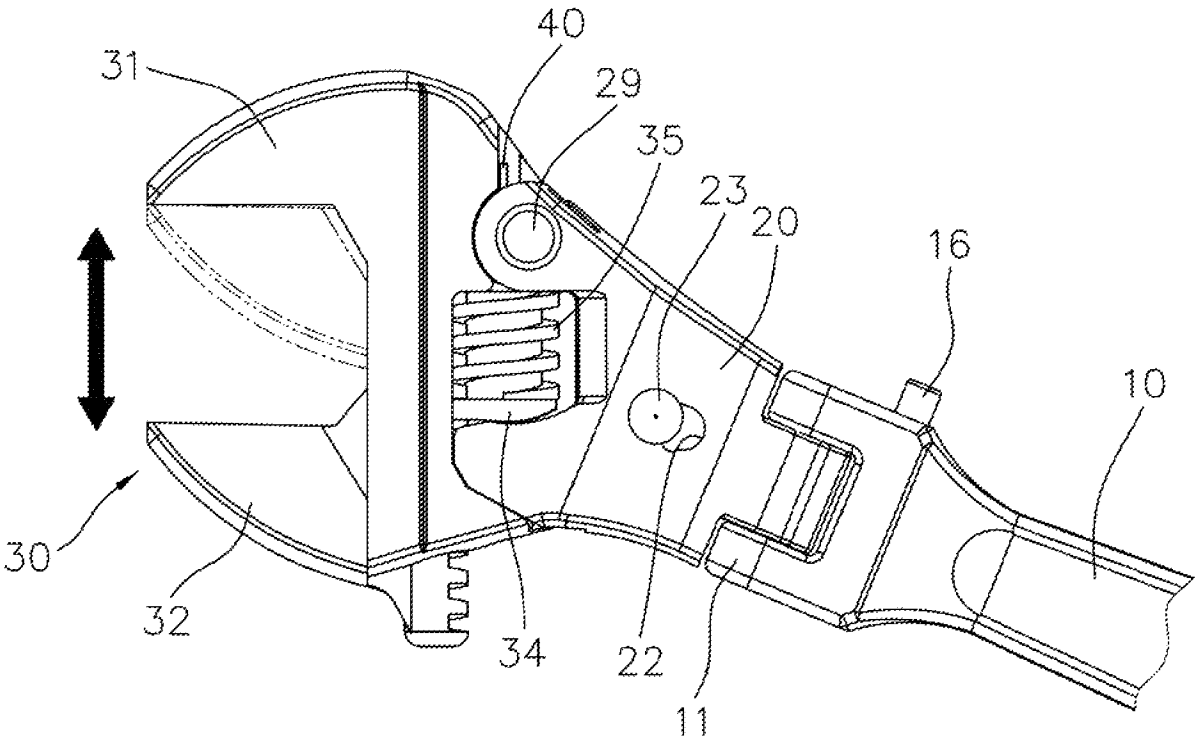
FIG. 5 shows that the movable jaw is moved away from the fixed jaw of the wrench of the present invention.
Figure 6:
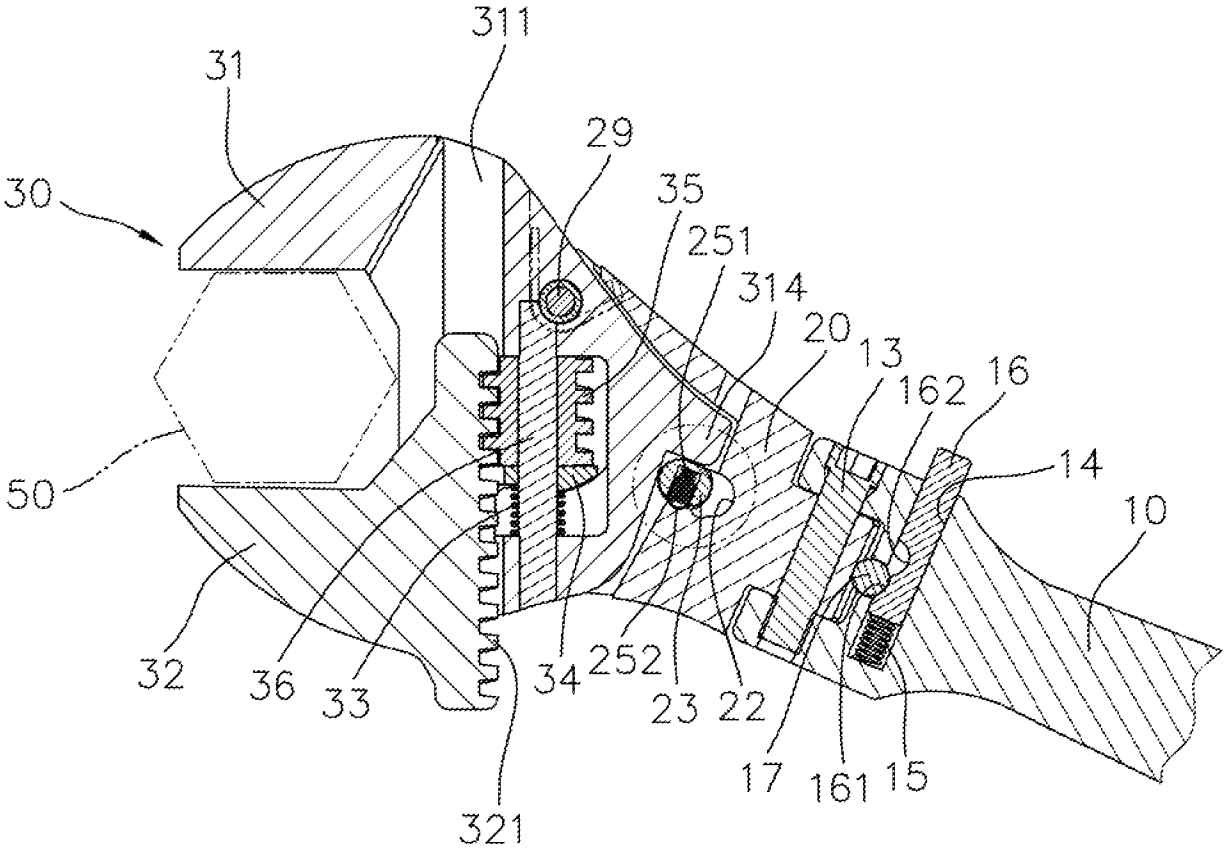
FIG. 6 is a cross sectional view to show the wrench of the present invention.
Figure 7:
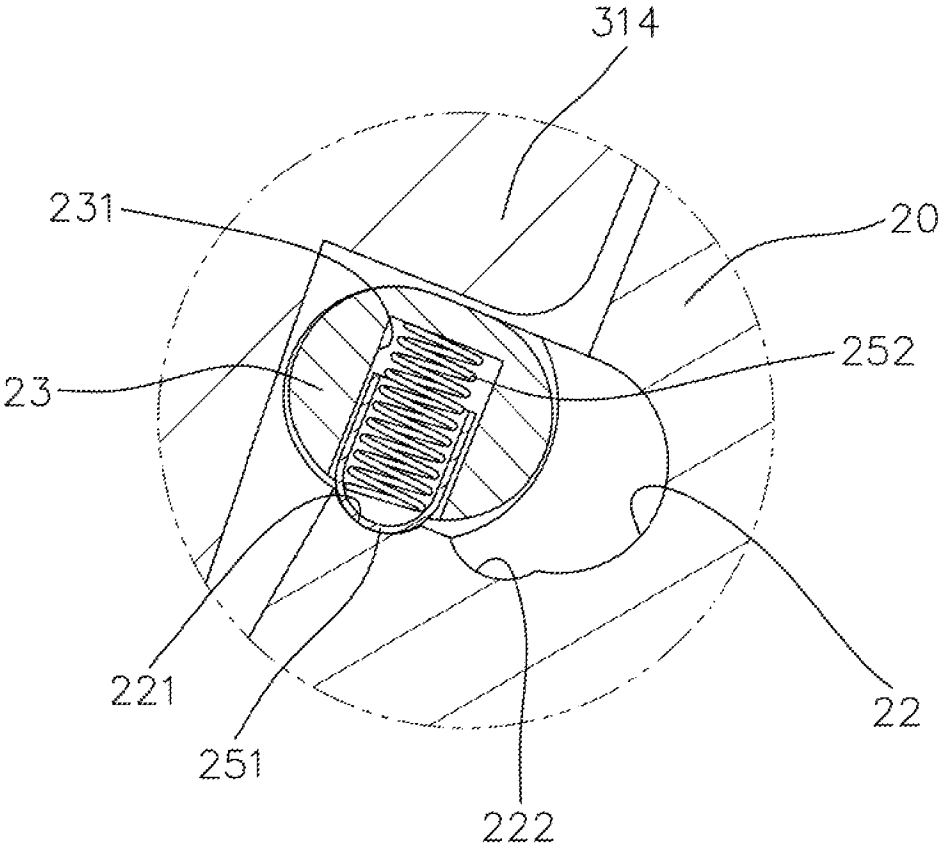
FIG. 7 is an enlarged view to show the circled portion in FIG. 6.

Referring to FIGS. 1 to 6, the adjustable wrench of the present invention comprises a handle 10 having two lugs 11 extending from one end thereof and each lug 11 has a through hole 12. A head 20 has a protrusion 21 extending from the first end thereof and a passage 211 is defined through the protrusion 211. The protrusion 21 is located between the two lugs 11 and a pivot 13 extends through the two through holes 12 and the passage 211. The head 20 has a guide hole 22 which has a first position 221 and a second position 222. A pin 23 extends through the guide hole 22 and has a side hole 231 defined radially in the outer periphery thereof. A positioning unit 25 is located in the side hole 231 and engaged with the first position 221 of the guide hole 22. The head 20 has a slot 26 defined in the second end thereof and an opening 27 is defined in one side of the head 20 and communicates with the slot 26. Two wing plates 28 extend from the head 20 and each wing plate 28 has a hole 281. A pin 29 extends through the holes 281 of the two wing plates 28.

A clamping device 30 has a fixed jaw 31 and a movable jaw 32, wherein the fixed jaw 31 has a travel path 311 and the movable jaw 32 has a toothed rod 321 connected thereto. A slide slot 312 is defined in one side of the fixed jaw 31. The fixed jaw 31 has a board 313 extending therefrom and the board 313 is inserted into the slot 26 of the head 20. The board 313 has a stop 314 extending therefrom such that a triangular recess is defined between the stop 314 and the lower side of the board 313. The fixed jaw 31 has an opening 315 in which a push spring 33, a stop plate 34 and a worm rod 35 are received. A pin 36 extends through the push spring 33, the stop plate 34 and the worm rod 35. The fixed jaw 31 is connected to the head 20 by inserting the board 313 in the slot 26 of the head 20. The pin 29 extends through the two wing plates 28, a torsion spring 40 and the board 313, wherein the torsion spring 40 has two legs which are respectively in contact with the slot 26 of the head 20 and one side of the fixed jaw 31. The movable jaw 32 is slidably connected to the slide slot 312. The toothed rod 321 is located in the travel path 311 and engaged with the worm rod 35.

A recess 14 is defined in the handle 10 and located close to the lugs 111. A resilient member 15 and a push rod 16 are located in the recess 14. The push rod 16 has a first notch 161 and a second notch 162. A bead 17 is engaged with one of the first and second notches 161, 162. The head 20 has multiple third notches 212 defined in the outer periphery of the protrusion 21 and the bead 17 is engaged with one of the third notches 212. In this embodiment, the resilient member 15 is a spring, and the positioning unit 25 comprises a spring 251 and an end piece 252.

Each of the wing plates 28 of the head 20 has a curved face 282 defined in the outer periphery thereof. The fixed jaw 31 has a recessed portion 310 with which the curved face 282 is engaged.

When using the wrench to tighten or loosen the nut 50, as shown in FIGS. 6 to 9, the nut 50 is positioned between the fixed jaw 31 and the movable jaw 32, the worm rod 35 is rotated to drive the toothed rod 321 so that the movable jaw 32 is moved toward to the fixed jaw 31 and contacts the nut 50. By rotating the handle 10, the nut 50 is tightened or loosened.

Figure 8:
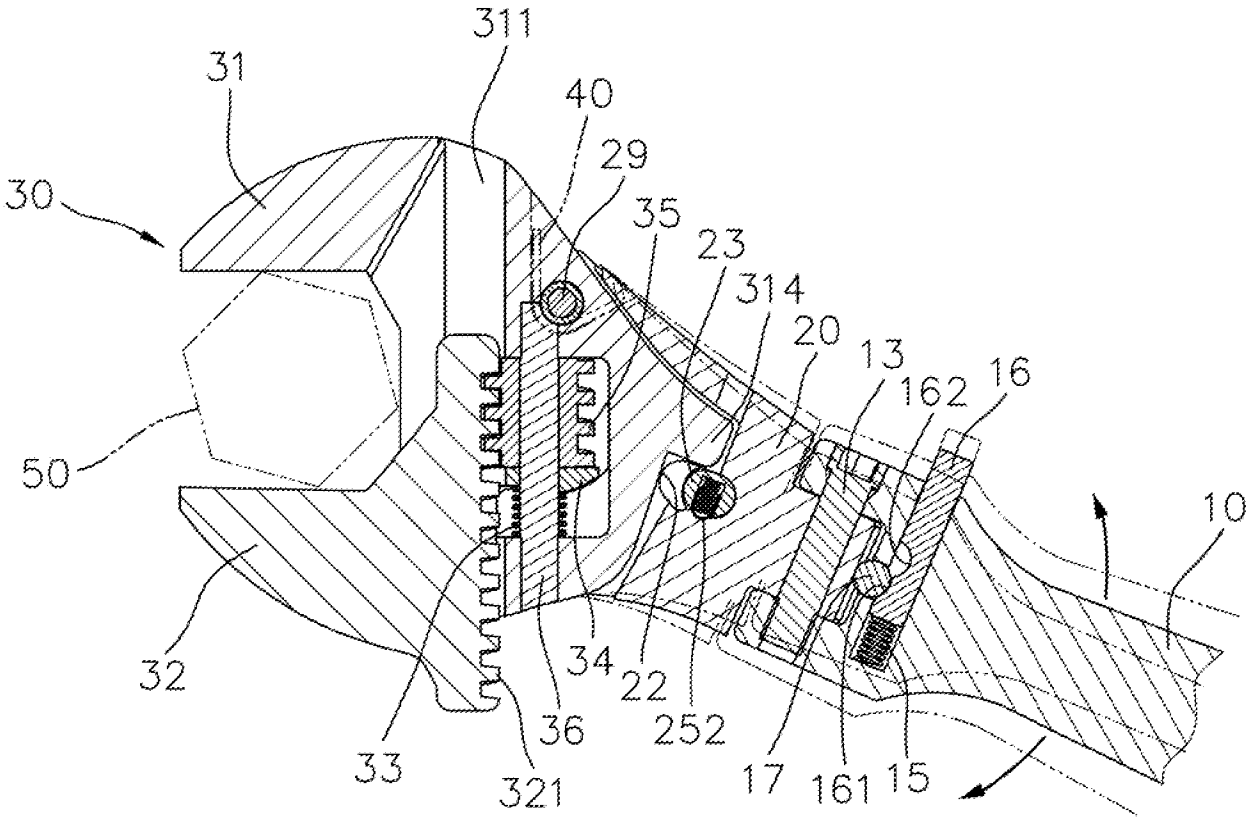
FIG. 8 is a cross sectional view to show that the handle of the wrench of the present invention is rotated.

When shifting the pin 23 from the first position 221 to the second position 222, as shown in FIG. 8, the pin 23 no longer pushes the lower side of the board 313 in the direction away from the handle 10, in other words, the clamping device 30 is released from the pin 23, so that the clamping unit 30 is pivotable about the pin 29. By the push spring 33, the clamping unit 30 is able to clamp the nut 50 constantly so that the user can rotate the handle 10 like operating a ratchet tool.

Figure 9:
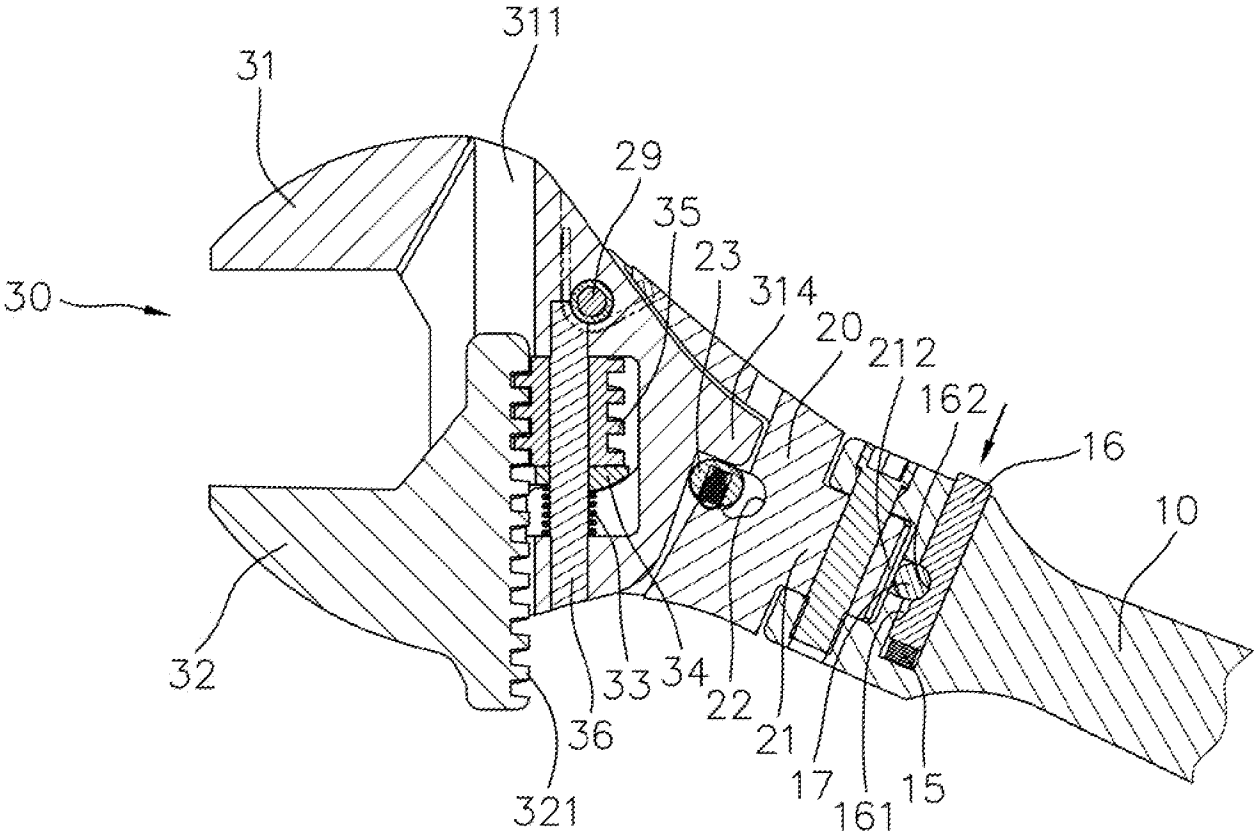
FIG. 9 shows that the push rod is pushed downward.
Figure 10:
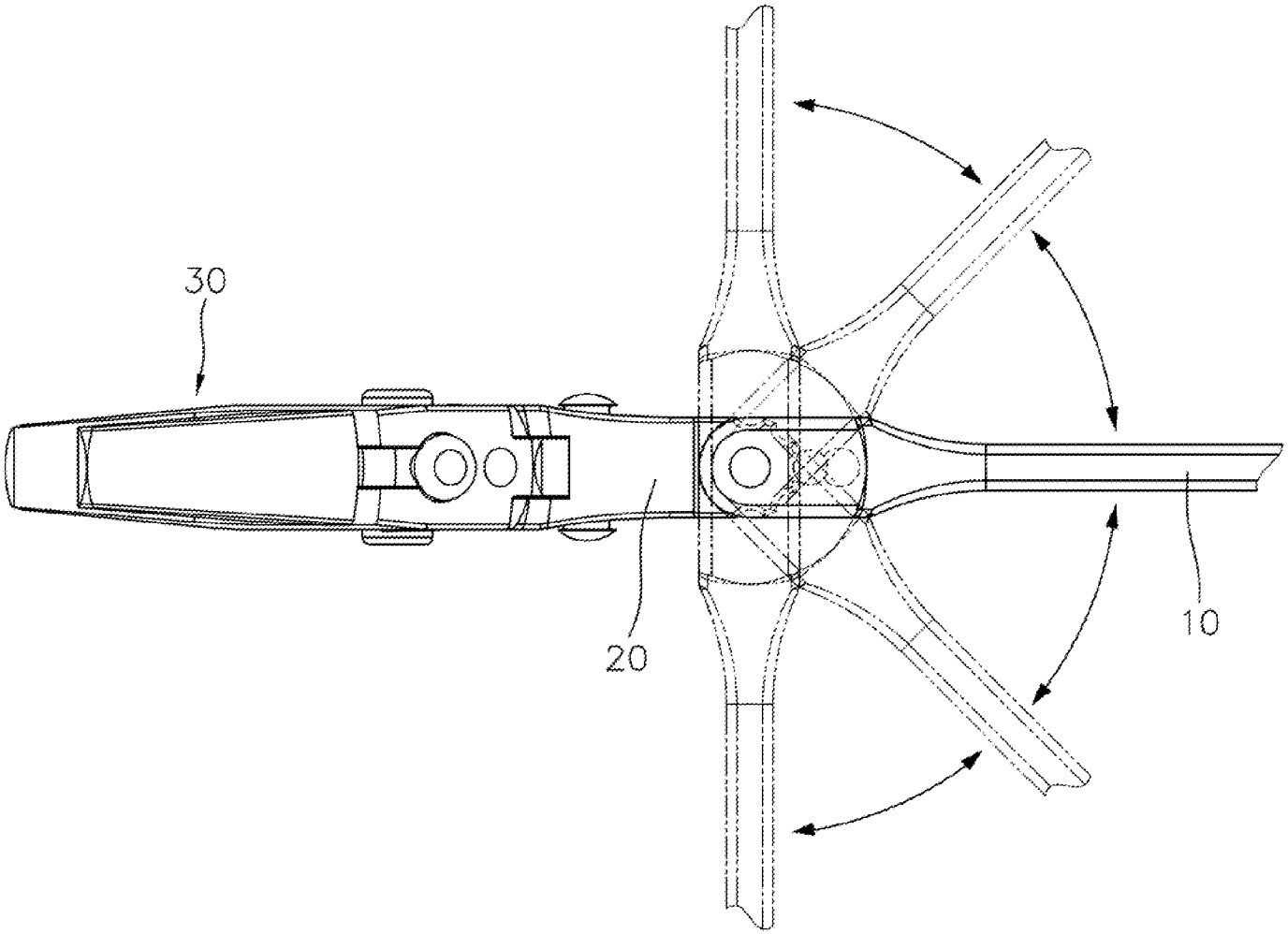
FIG. 10 shows that the head of the wrench is pivotable.

When the user pushes the push rod 16, the bead 17 is moved from the first notch 161 to the second notch 162, and the bead 17 is disengaged from the third notch 212 of the head 20, as shown in FIG. 9, so that the handle 10 and the head 20 are pivoted relative to each other to a desired angular position as shown in FIG. 10. When the push rod 16 is released, the resilient member 15 pushes the push rod 16 back to its initial position. The bead 17 is moved from the second notch 162 to the first notch 161, and is engaged with one of the third notches 212 so as to set the head 20 in position. Therefore, the wrench reaches the nut 50 at an angular portion.

The adjustable wrench has a pivotable head 20 connected with the clamping unit 30, and the clamping unit 30 can be used as a ratchet hand tool. The two features provide the adjustable wrench with more abilities.

While we have shown and described the embodiment in accordance with the present invention, it should be clear to those skilled in the art that further embodiments may be made without departing from the scope of the present invention.

What is claimed is:

1. An adjustable wrench comprising:

a handle having two lugs extending from one end thereof and each lug having a through hole;

a head having a protrusion extending from a first end thereof and a passage defined through the protrusion, the protrusion located between the two lugs and a pivot extending through the two through holes and the passage, the head having a guide hole which has a first position and a second position, a pin extending through the guide hole and having a side hole defined radially in an outer periphery thereof, a positioning unit located in the side hole and engaged with the first position of the guide hole, the head having a slot defined in a second end thereof and an opening defined in a side of the head and communicating with the slot, two wing plates extending from the head and each wing plate having a hole, a pin extending through the holes of the two wing plates, and a clamping device having a fixed jaw and a movable jaw, the fixed jaw having a travel path and the movable jaw having a toothed rod connected thereto, a slide slot defined in a side of the fixed jaw, the fixed jaw having a board extending therefrom and the board inserted into the slot of the head, the board having a stop extending therefrom, the fixed jaw having an opening in which a push spring, a stop plate and a worm rod are received, a pin extending through the push spring, the stop plate and the worm rod, the fixed jaw connected to the head by inserting the board in the slot of the head, the pin extending through the two wing plates and the board, the movable jaw being slidably connected to the slide slot, the toothed rod located in the travel path and engaged with the worm rod.

2. The wrench as claimed in claim 1, wherein a recess is defined in the handle and located close to the lugs, a resilient member and a push rod are located in the recess, the push rod has a first notch and a second notch, a bead is engaged with one of the first and second notches, the head has multiple third notches defined in an outer periphery of the protrusion and the bead is engaged with one of the third notches.

3. The wrench as claimed in claim 2, wherein the resilient member is a spring.

4. The wrench as claimed in claim 1, wherein the positioning unit comprises a spring and an end piece.

5. The wrench as claimed in claim 1, wherein each of the wing plates of the head has a curved face defined in an outer periphery thereof, the fixed jaw has a recessed portion with which the curved face is engaged.

6. The wrench as claimed in claim 1, wherein the pin extends through the holes of the two wing plates and a torsion spring, the torsion spring has two legs which are respectively in contact with the slot of the head and a side of the fixed jaw.

* * * * *